US006294502B1

(12) United States Patent
Fisher et al.

(10) Patent No.: US 6,294,502 B1
(45) Date of Patent: Sep. 25, 2001

(54) THERMALLY-RESPONSIVE RECORD MATERIAL

(75) Inventors: Mark Robert Fisher, Appleton; John Charles DeBraal, Kaukauna, both of WI (US); Guido Steffan, Odenthal; Peter P. Wenzl, Cologne, both of (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 09/312,884

(22) Filed: May 14, 1999

Related U.S. Application Data

(63) Continuation-in-part of application No. 09/083,807, filed on May 22, 1998, now Pat. No. 6,015,771.

(51) Int. Cl.[7] ..... B41M 5/26

(52) U.S. Cl. ..... 503/209; 503/200; 503/208; 503/226

(58) Field of Search ..... 503/208, 209, 503/200, 226

(56) References Cited

U.S. PATENT DOCUMENTS

| | | | |
|---|---|---|---|
| 3,491,111 | 1/1970 | Lin | 260/315 |
| 3,491,112 | 1/1970 | Lin | 260/315 |
| 3,539,375 | 11/1970 | Baum | 117/36.2 |
| 3,624,107 | 11/1971 | Lin | 260/343.3 |
| 3,641,011 | 2/1972 | Lin et al. | 260/240 G |
| 3,642,828 | 2/1972 | Farber et al. | 260/343.3 |
| 3,674,535 | 7/1972 | Blose et al. | 117/36.8 |
| 3,681,390 | 8/1972 | Lin | 260/335 |
| 3,746,675 | 7/1973 | Blose et al. | 260/23 EM |
| 3,775,424 | 11/1973 | Farber | 260/295 B |
| 3,853,869 | 12/1974 | Farber | 260/250 BC |
| 3,862,210 | 1/1975 | Murayama et al. | 260/471 C |
| 4,095,034 | 6/1978 | Mangold et al. | 560/134 |
| 4,151,748 | 5/1979 | Baum | 73/356 |
| 4,181,771 | 1/1980 | Hanson et al. | 428/327 |
| 4,246,318 | 1/1981 | Baum | 428/411 |
| 4,258,201 | 3/1981 | Moy | 560/24 |
| 4,260,781 | 4/1981 | Harvey | 560/24 |
| 4,301,087 | 11/1981 | Greene | 260/463 |
| 4,443,621 | 4/1984 | LaMattina et al. | 560/142 |
| 4,443,622 | 4/1984 | Smith | 560/166 |
| 4,470,057 | 9/1984 | Glanz | 346/209 |
| 4,720,301 | 1/1988 | Kito et al. | 106/21 |
| 4,732,810 | 3/1988 | Kito et al. | 428/402.2 |
| 5,270,281 * | 12/1993 | Otsuji et al. | 503/209 |
| 5,312,796 | 5/1994 | Nishimura et al. | 503/209 |

FOREIGN PATENT DOCUMENTS

| | | |
|---|---|---|
| 1594422 | 7/1981 | (GB) . |
| 2131189 | 6/1984 | (GB) . |
| 57128591 | 8/1982 | (JP) . |
| 60107387 * | 6/1985 | (JP) . |
| 61-182982 | 8/1986 | (JP) . |
| 63-242679 | 10/1988 | (JP) . |
| 645883 | 1/1989 | (JP) . |
| 04331184 * | 11/1992 | (JP) . |
| 9-11631 | 1/1997 | (JP) . |
| 09221464 * | 8/1997 | (JP) . |

OTHER PUBLICATIONS

Akira Igarashi, Teppei Ikeda, "Mechanisms of Color Formation on Thermo–Sensitive Paper," Scientific Publication of the Fuji Photo Film Co., Ltd., No. 29, 97 (Advances in Non–Impact Printing Technologies for Computer & Office Application, Proceedings of the First International Congress, Venice, Italy, Jun. 22–26, 1981.

* cited by examiner

*Primary Examiner*—Bruce H. Hess
(74) *Attorney, Agent, or Firm*—Jospeh C. Gil; Diderico van Eyl

(57) ABSTRACT

The invention discloses a novel thermally-responsive record material comprising a support having coated thereon a thermally sensitive color forming composition comprising a chromogenic material, an acidic developer material and a certain carbamate component that does not include dodecyl-N-phenylcarbamate. The novel record material displays enhanced image intensity or improved thermal response.

10 Claims, No Drawings

THERMALLY-RESPONSIVE RECORD MATERIAL

CROSS-REFERENCE TO RELATED APPLICATIONS

This is a Continuation-in-Part application of U.S. Ser. No. 09/083,807 filed on May 22, 1998, now U.S. Pat. No. 6,015,771.

FIELD OF THE INVENTION

The invention relates to a thermally-responsive record material.

BACKGROUND OF THE INVENTION

The invention relates to a thermally-responsive record material. It more particularly relates to such record material in the form of sheets coated with color-forming compositions comprising chromogenic material (electron-donating dye precursors) and acidic color developer material. The invention particularly concerns a thermally-responsive record material (thermal record material) capable of forming a substantially non-reversible image with improved color-forming efficiency and/or image density.

Thermally-responsive record material systems are well known in the art and are described in many patents, for example: U.S. Pat. Nos. 3,539,375; 3,674,535; 3,746,675; 4,151,748; 4,181,771; 4,246,318; and 4,470,057 which are incorporated herein by reference. In these systems, basic chromogenic material and acidic color developer material are contained in a coating on a substrate which, when heated to a suitable temperature, melts or softens to permit said materials to react, thereby producing a colored mark.

Carbamate compounds are known (See. U.S. Pat. No. 4,095,034, U.S. Pat. No. 4,260,781, U.S. Pat. No. 4,301,087 and U.S. Pat. No. 4,443,621). None of these patents teach thermally-sensitive color-forming compositions containing carbamates or suggest that their respective U.S. Pat. No. 4,443,621). None of these patents teach thermally-sensitive color-forming compositions containing carbamates or suggest that their respective carbamates can be used as components of a thermally-sensitive color-forming composition. Igarishi et al's, Mechanisms of Color Formation on Thermo-Sensitive Paper, Scientific Publications of the Fuji Photo Film Co., Ltd., No 29, 97 (Advances in Non-Impact Printing Technologies for Computer and Office Application, Proceedings of the First International Congress, Venice, Italy, Jun. 22–26 (1981)) discusses certain mechanisms of color formation of a very specific thermo-sensitive paper referred to as "NCR type". The reference discloses that dodecyl-N-phenylcarbamate can be used as a sensitizer to increase the sensitivity of paper, "so that the recording density at the same recording energy is three or four times higher than in ordinary paper" (page 98). Stearylamide can also be used with less success. Dodecyl-N-phenylcarbamate is the only carbamate discussed by the reference and there is no discussion about how structurally different carbamates would function.

Thermally-responsive record materials have characteristic thermal responses, desirably producing a color image upon selective thermal exposure.

In the field of thermally-responsive record material, thermal response is defined as the temperature at which a thermally-responsive record material produces a colored image of sufficient intensity (density). The desired temperature of imaging varies with the type of application of the thermally-responsive product and the equipment in which the imaging is to be performed. The ability to shift the temperature at which a satisfactorily intense thermal image is produced for any given combination of chromogenic material and developer material is a much sought after and very valuable feature.

The ability of a thermally-responsive record material to have improved imaging characteristics such as enhanced image intensity, image density, or improved thermal response, would be an advance in the art and of commercial significance.

SUMMARY OF THE INVENTION

The invention relates to a novel thermally-responsive record material comprising a support having provided thereon, in substantially contiguous relationship, a thermally-sensitive color-forming composition. The thermally-sensitive color-forming composition contains compounds that can be named as carbamates, but can also be named as carbonyl amines. In some literature, some of these carbamates are also referred to as phenoxy-ethoxy derivatives. The carbamates used in the invention do not include dodecyl-N-phenylcarbamate. These and other features, aspects, and advantages will become better understood with reference to the following description and appended claims.

DETAILED DESCRIPTION OF THE INVENTION

The invention relates to a novel thermally-responsive record material containing a substrate bearing a thermally-sensitive color-forming composition containing in contiguous relationship (i) an electron-donating dye precursor, (ii) an acidic developer material and (iii) a carbamate component that does not include dodecyl-N-phenylcarbamate, whereby the melting or sublimation of either material produces a change in color by reaction between the components (i) and (ii). The thermally-sensitive color-forming composition is coated on a substrate in one or more layers.

Generally the carbamates include a component selected from the group of compounds consisting of A) compounds according to formula (I)

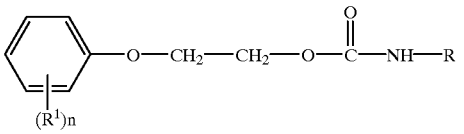

(I)

wherein R is selected from substituted and unsubstituted aryl groups, substituted and unsubstituted alkyl groups, and substituted and unsubstituted aralkyl groups, $R^1$ includes a component selected from the group consisting of $OCH_3$, $CH_2$, and Cl, and n is 0, 1, or 2, and the alkyl moeity in each of the preceeding is selected to be from one to eight carbon atoms and the aryl moeity in each of the preceeding is selected to be from six to eighteen carbon atoms;

B) compounds according to formula (II)

(II)

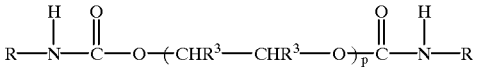

wherein p=1, 2 or 3, $R^3$ represents independently from each other H or ethyl and R has the same meaning as in formula (I);

C) compounds according to formula (III)

(III)

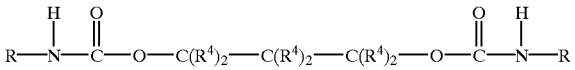

wherein $R^4$ represents independently from each other H or $C_1$–$C_6$ alkyl and R has the same meaning as in formula (I);

D) compounds according to formula (IV);

(IV)

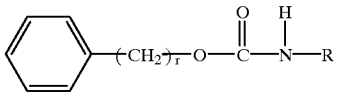

wherein r=0, 1 or 2 and R has the same meaning as in formula (I),

E) compounds according to formula (V)

(V)

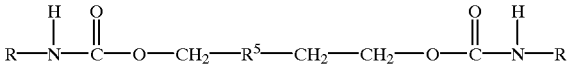

wherein $R^5$ is

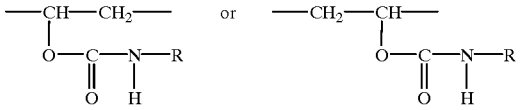

wherein R has the same meaning as in formula (I) and

F) compounds according to formula (VI)

(VI)

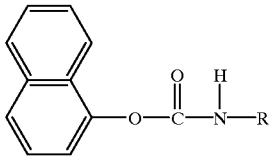

wherein R has the same meaning as in formula (I),

G) compounds according to formula (VII)

(VII)

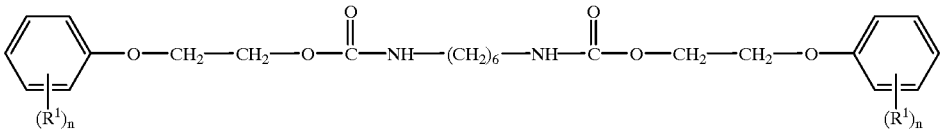

wherein $R^1$ and n have the same meaning as in formula (I) and

H) compounds according to formula (VIII)

(VIII)

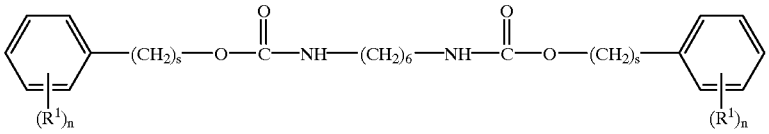

wherein $R^1$ and n have the same meaning as in formula (I) and s is 0, 1 or 2.

Below are preferred and specific examples of compounds covered by formulae (I)–(VIII).

In formula (I) the aryl groups have a preferred carbon atom number of 6–12 and phenyl, naphthyl and biphenyl are the most preferred aryl groups. Preferred substituents for aryl groups generally include alkyl and alkoxy groups having from 1 to 8 carbon atoms as well as halogen groups. More preferred substituents of aryl groups include $CH_3$, $C_2H_5$, and Cl. Preferred carbamates of formula (I) have the formula (Ia):

I(a)

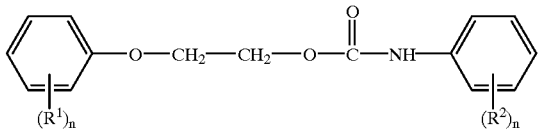

wherein $R^1$ and n have the same meaning as in formula I and $R^2$ is selected from the group of $CH_3$, $C_2H_5$, and Cl and m is 0 or 1.

Specific examples of carbamates according to formula (Ia) include:

N-phenyl-N-(2-phenoxyethoxycarbonyl) amine (can also be named as 2-phenoxyethyl-N-phenylcarbamate)

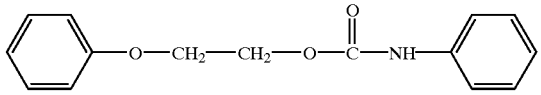

N-phenyl-N-(2-(3-methoxyphenoxy)ethoxycarbonyl) amine

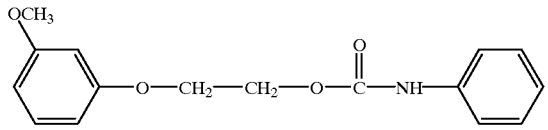

N-(2-methylphenyl)-N-(2-phenoxyethoxycarbonyl) amine

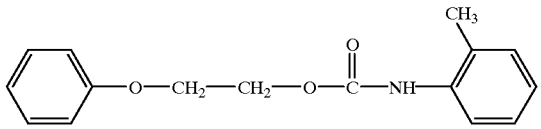

N-(2-methylphenyl)-N-(2-(4-methylphenoxy) ethoxycarbonyl)amine

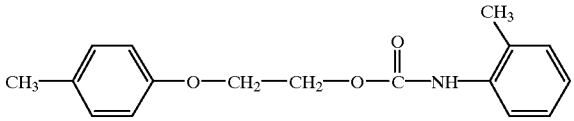

N-phenyl-N-(2-(2-chlorphenoxy)ethoxycarbonyl)amine

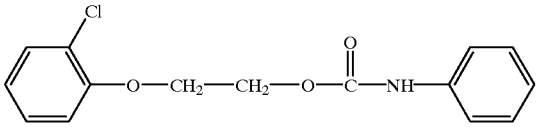

N-(4-chlorphenyl)-N-(2-phenoxyethoxycarbonyl)amine

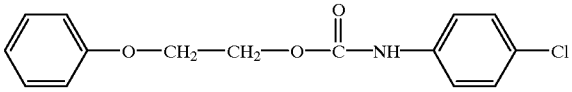

N-(2-methylphenyl)-N-(2-(2-methoxyphenoxy) ethoxycarbonyl)amine

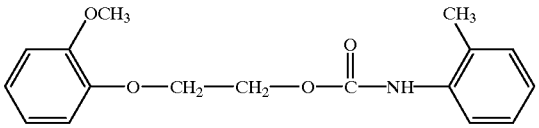

N-(4-chlorphenyl)-N-(2-(3-methylphenoxy) ethoxycarbonyl)amine

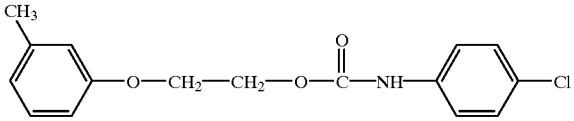

N-(4-chlorphenyl)-N-(2-(2-methylphenoxy) ethoxycarbonyl)amine

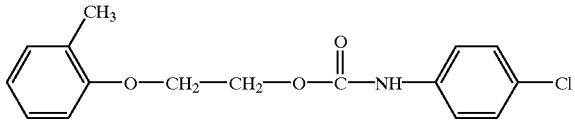

N-phenyl-N-(2-(4-chlorphenoxy)ethoxycarbonyl)amine

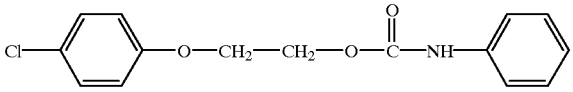

N-phenyl-N-(2-(4-methylphenoxy)ethoxycarbonyl) amine

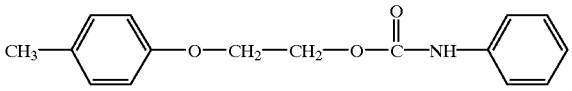

N-(4-chlorphenyl)-N-(2-(4-methylphenoxy) ethoxycarbonyl)amine

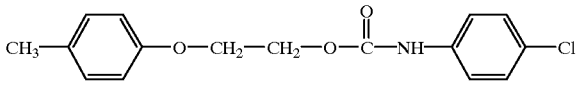

N-(4-chlorphenyl)-N-(2-(2-chlorphenoxy) ethoxycarbonyl)amine

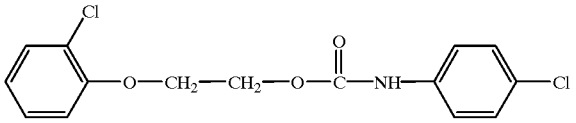

N-(4-chlorphenyl)-N-(2-(4-chlorphenoxy) ethoxycarbonyl)amine

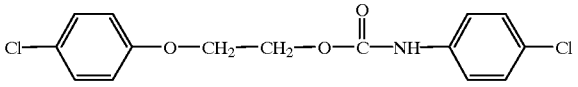

N-(4-chlorphenyl)-N-(2-(2-methoxyphenoxy) ethoxycarbonyl)amine

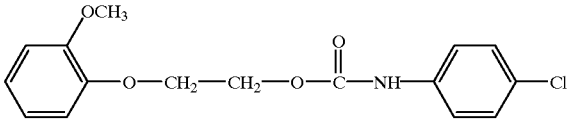

N-(3-methylphenyl)-N-(2-phenoxyethoxycarbonyl) amine

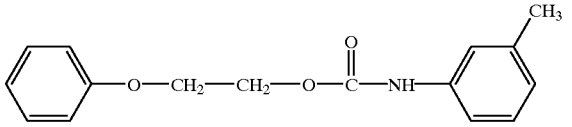

N-(3-methylphenyl)-N-(2-(2-methylphenoxy (ethoxycarbonyl)amine

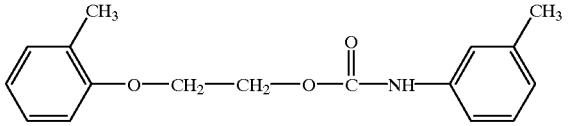

N-(3-methylphenyl)-N-(2-(3-methylphenoxy (ethoxycarbonyl)amine

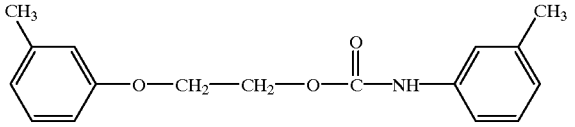

N-(3-methylphenyl)-N-(2-(2-chlorphenoxy) ethoxycarbonyl)amine

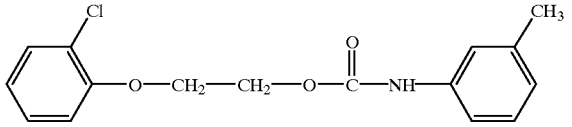

N-(3-methylphenyl)-N-(2-(2,4-dichlorphenoxy) ethoxycarbonyl)amine

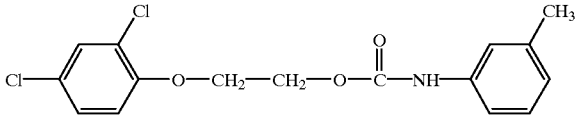

N-(2-methylphenyl)-N-(2-(2,4-dichlorphenoxy) ethoxycarbonyl)amine

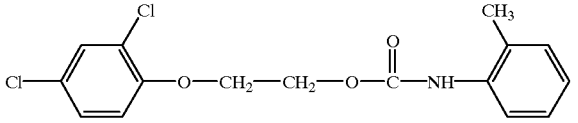

N-(2-methylphenyl)-N-(2-(2-chlorphenoxy) ethoxycarbonyl)amine

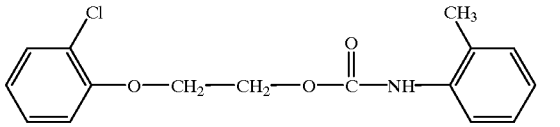

N-(3-methylphenyl)-N-(2-(2-methoxyphenoxy) ethoxycarbonyl)amine

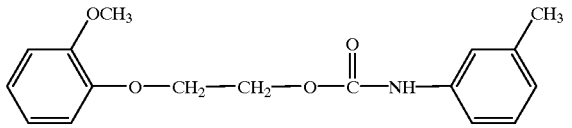

N-phenyl-N-(2-(2-methylphenoxy)ethoxycarbonyl) amine

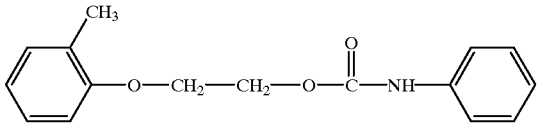

N-(2-methylphenyl)-N-(2-(2-methylphenoxy) ethoxycarbonyl)amine

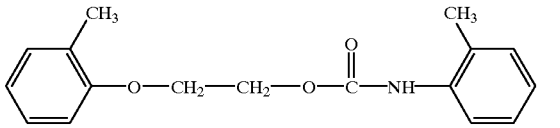

N-phenyl-N-(2-(2,4-dichlorphenoxy)ethoxycarbonyl) amine

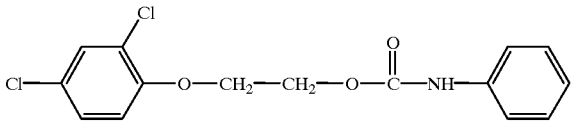

N-(3-methylphenyl)-N-(2-(4-methylphenoxy) ethoxycarbonyl)amine

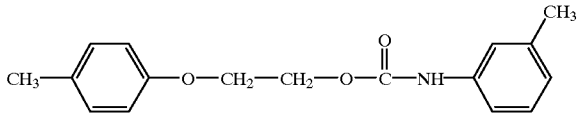

N-(2-methylphenyl)-N-(2-(3-methylphenoxy) ethoxycarbonyl)amine

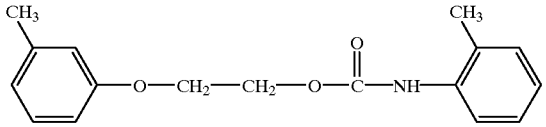

N-phenyl-N-(2-(4-methylphenoxy)ethoxycarbonyl) amine

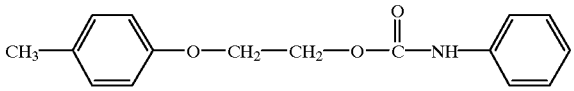

N-(4-ethylphenyl)-N-(2-phenoxyethoxycarbonyl)amine

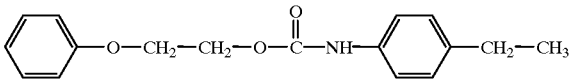

N-(4-methylphenyl)-N-(2-phenoxyethoxycarbonyl) amine

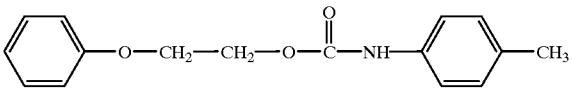

Other specific carbamates according to formula (I) include:

N-ethyl-N-(2-phenoxyethoxycarbonyl)amine

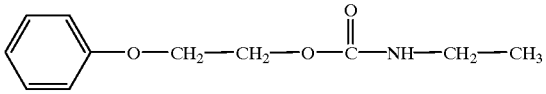

N-methyl -N-(2-phenoxyethoxycarbonyl)amine

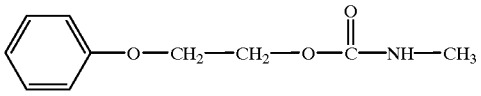

N-propyl-N-(2-phenoxyethoxycarbonyl)amine

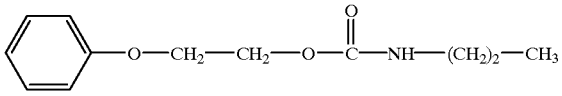

N-octyl-N-(2-phenoxyethoxycarbonyl)amine

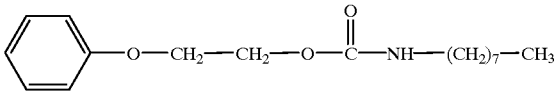

Specific compounds according to formula (II) include:

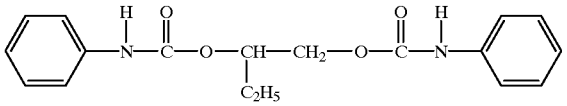

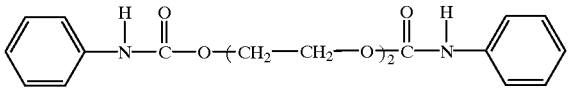

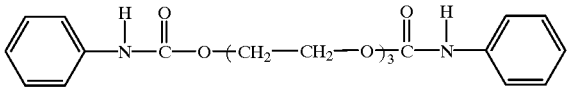

Specific examples of the carbamates according to formula (III) include:

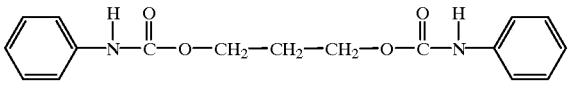

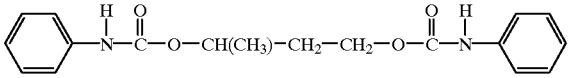

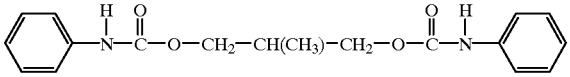

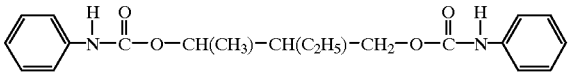

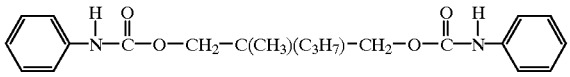

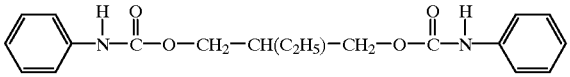

-continued
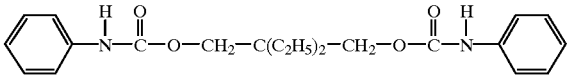
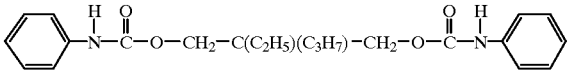
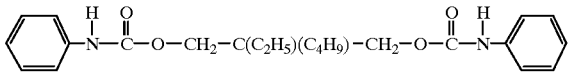
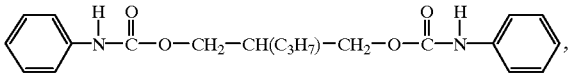
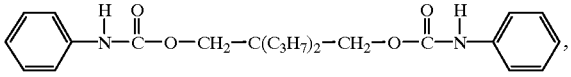
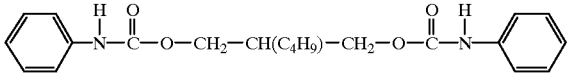
and
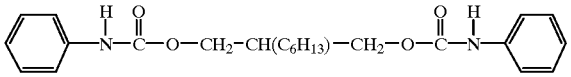
Specific examples of the carbamates according to formula (IV) include:
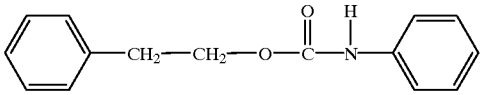
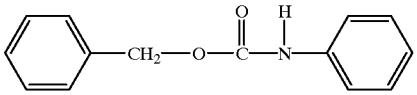
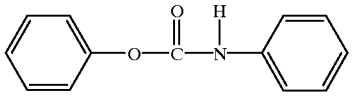
Specific examples of the carbamates according to formula (V) and (VI) include:
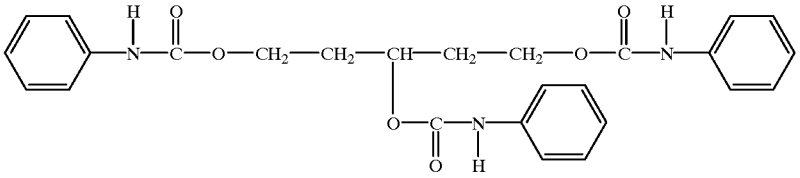
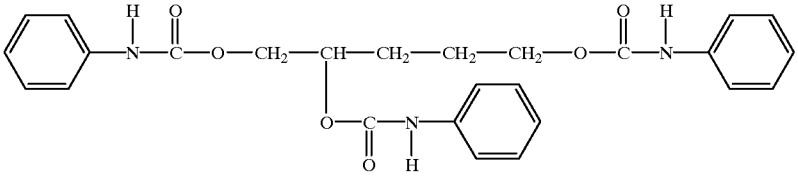
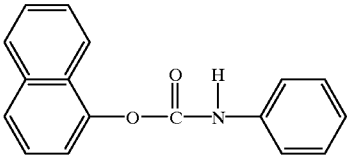
A specific example of the carbamates according to formula (VII) is

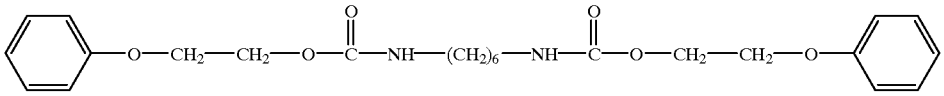

A specific example of the carbamates according to formula (VIII) is

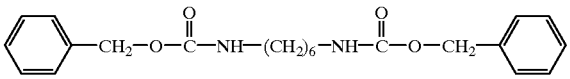

Particulary preferred among the carbamate compounds of the invention are

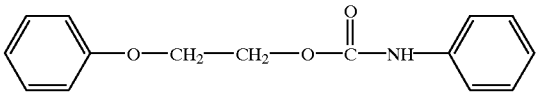

and

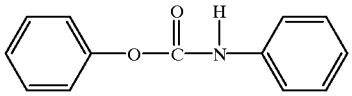

The carbamates of the invention desirably function as a sensitizer facilitating reaction between the mark-forming components yielding a more intense image at lowered temperatures or faster imaging. The thermally-responsive record material of the invention has the surprising property of being capable of forming a stable non-reversible high density image upon thermal contact at lower thermal energies.

While the carbamate used in the invention is a known material, it has heretofore not found use in the thermal record material industry. Surprisingly, the material according to the invention has remarkable properties beneficial to the manufacture of improved thermal record material. Carbamates according to formulae (I)–(VIII) are commercially available from chemical specialty manufacturers, such as Bayer AG, alternatively would be able to be synthesized by one skilled in the art.

Carbamates according to the invention can be synthesized by reacting a corresponding carbamyl compound with a corresponding hydroxy compound at a temperature near the decomposition temperature of the carbamyl chloride in mono- or poly-substituted alkyl or halo-benzene as solvent. These and other synthetic processes are described in the literature included in such patents as U.S. Pat. Nos. 4,095,034; 4,443,622; 4,301,087; 4,258,201; and 4,260,781 incorporated herein by reference.

Other synthetic routes would be apparent to the artisan having skill in the synthetic arts. The invention resides in the surprising combination of this material within a thermal imaging record material.

As such, the invention comprises a thermally sensitive color-forming composition comprising an electron-donating dye precursor (chromogenic material), an acidic developer material and a carbamate, in particular a carbamate of formulae (I)–(VIII) and, if appropriate a binder material. The unexpected feature of this composition is that the inclusion of the carbamate, which is in particular a compound of formulae (I)–(VIII) facilitates the color-forming reaction resulting in a more intense image or faster imaging by image formation at lower temperature. The record material according to the invention has a non-reversible image in that it is substantially non-reversible under the action of heat. The coating of the record material of the invention is basically a dewatered solid at ambient temperature and differs from reversible solvent liquid based compositions such as taught by Kito et al., in U.S. Pat. Nos. 4,720,301 and 4,732,810 which erase upon exposure to elevated temperature from 20° C. to 50° C. The image herein formed is non-reversible at such temperature. The color-forming composition (or system) of the record material of the invention comprises chromogenic material (electron-donating dye precursor) in its substantially colorless state, acidic developer material such as, for example, phenolic compounds. The color-forming composition relies upon melting, softening, or subliming one or more of the components to achieve reactive, color-producing contact.

The record material includes a substrate or support material which is generally in sheet form. For purposes of the invention, sheets can be referred to as support members and are understood to also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The gist of the invention resides in the color-forming composition coated on the substrate. The kind or type of substrate material is not critical.

The components of the thermally sensitive color-forming composition are in a substantially contiguous relationship, substantially homogeneously distributed throughout the coated layer or layers of material deposited on the substrate.

The phrase "substantially contiguous relationship" is understood to mean that the components of the color-forming composition are positioned in sufficient proximity such that upon meting, softening or subliming one or more of the components, a reactive color forming contact between the components is achieved. As is readily apparent to the person of ordinary skill in this art, these reactive components accordingly can be in the same coated layer or layers, or isolated or positioned in separate layers. In other words, one component can be positioned in the first layer, and reactive or sensitizer components, or the carbamate or acidic developer, positioned in a subsequent layer or layers. The coating can optionally be applied to all of the substrate or spot printed on a certain portion. All such arrangements are understood herein as being substantially contiguous.

The thermal record material can optionally include a variety of pre-coats such as a base layer of clay, and absorptive pigments such as kaolin clays, insulators such as hollow sphere particles, pigments, particulate clays, starch, or synthetic polymeric materials. Hollow sphere particles are commercially available such as the "Ropaque" materials of Rohm and Haas.

Optionally, the thermally-sensitive color-forming composition can be formed as a top layer on the substrate which top layer is then over-coated with a protective layer or barrier layer formed from one or more water soluble or dispersible polymeric materials such as polyvinyl alcohol, carboxylated polyvinyl alcohol, methyl or ethyl cellulose, polyacrylamide, gelatin, starch or polyvinyl pyrrolidone.

Optionally, a protective layer using the same or different materials can be applied as a back coat to the thermally-sensitive record material. Materials useful as pre-coats, such as the hollow sphere particles, pigments, clays and synthetic polymeric particulate materials can also be usefully included in the back coat. In manufacturing the record material, a coating composition is prepared which includes a fine dispersion of the components of the color-forming system, polymeric binder material, surface active agents and other additives in an aqueous coating medium. The composition can additionally contain inert pigments, such as clay, talc, aluminum hydroxide, calcined kaolin clay and calcium carbonate; synthetic pigments, such as urea-formaldehyde resin pigments; natural waxes such as Carnuba wax; synthetic waxes; lubricants such as zinc stearate; wetting agents; defoamers, and antioxidants. Other sensitizers can also be included. These sensitizers for example, can include acetoacet-o-toluidine, phenyl-1-hydroxy-2-naphthoate, 1,2-diphenoxyethane, and p-benzyl-biphenyl.

The color-forming system components are substantially insoluble in the dispersion vehicle (preferably water) and are ground to an individual average particle size of between about 1 micron to about 10 microns, preferably about 1–3 microns. The polymeric binder material is substantially vehicle soluble although latexes are also eligible in some instances. Preferred water soluble binders include polyvinyl alcohol, hydroxy ethyl-cellulose, methylcellulose, methyl-hydroxypropyl cellulose, starch, modified starches, gelatin and the like. Eligible latex materials include polyacrylates, styrene-butadiene-rubber latexes, polyvinylacetates, polystyrene, and the like. The polymeric binder is used to protect the coated materials from brushing and handling forces occasioned by storage and use of thermal sheets. Binder should be present in an amount to afford such protection and in an amount less than will interfere with achieving reactive contact between color-forming reactive materials.

Coating weights can effectively be about 3 to about 9 grams per square meter (gsm) and preferably about 5 to about 6 gsm. The practical amount of color-forming materials is controlled by economic considerations, functional parameters and desired handling characteristics of the coated sheets.

Eligible electron-donating dye precursors are chromogenic materials. Chromogenic materials such as the phthalide, leucauramine and fluoran compounds, for use in color-forming systems are well known color-forming compounds. Examples of the compounds include Crystal Violet Lactone (3,3-bis(4-dimethylaminophenyl)-6-dimethylaminophthalide, U.S. Pat. No. RE 23,024); phenyl-, indol-, pyrrol-, and carbazol-substituted phthalides (for example, in U.S. Pat. Nos. 3,491,111; 3,491,112; 3,491,116; 3,509,174); nitro-, amino-, amido-, sulfonamido-, aminobenzylidene-, halo-, anilino-substituted fluorans (for example, the U.S. Pat. Nos. 3,624,107; 3,627,78; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilino-flouran (U.S. Pat. No. 4,510,513) also known as 3-dibutylamino-6-methyl-7-anilino-fluoran; 3-dibutyl-amino-7-(2-chloroanilino) fluoran; 3-(N-ethyl-N-tetrahydro-furfuryl-amino)-6-methyl-7-3,5',6-tris(dimethylamino)spiro[9H-fluorene-9,1'(3'H)-isobenzofuran]-3'-one; 7-(1-ethyl-2-methylindol-3-yl)-7-(4-diethylamino-2-ethoxyphenyl)-5,7-dihydrofuro[3,4b]pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-dihydrofuro[3,4-b]pyridin-5-one; 3-diethylamino-7,8-benzofluoran; 3,3-bis(1-ethyl-2-methylindol-3-yl)phthalide; 3-diethyl-amino-7-anilinofluoran; 3-diethylamino-7-benzylaminofluoran; 3'-phenyl-7-dibenzylamino-2,2'-spirodi-[2H-1-benzopyran] and mixtures of any of the following.

Examples of eligible acidic developer material include the compounds listed in U.S. Pat. No. 3,539,375 as phenolic reactive material, particularly the monophenols and diphenols. Eligible acidic developer material also includes, without being considered as limiting, the following compounds which may be used individually or in mixtures: 4,4'-isopropylidinediphenol (Bisphenol A); p-hydroxybenzaldehyde; p-hydroxybenzo-phenone; p-hydroxypropiophenone; 2,4-dihydroxybenzophenone; 1,1-bis(4-hydroxyphenyl) cyclohexane; salicylanilide; 4-hydroxy-2-methyl-acetophenone; 2-acetylbenzoic acid; m-hydroxyacetanilide; p-hydroxy-acetanilide; 2,4-dihydroxyacetophenone; 4-hydroxy-4'-methylbenzophenone; 4,4'-dihydroxybenzophenone; 2,2-bis(4-hydroxyphenyl)4-methylpentane; benzyl 4-hydroxyphenyl ketone; 2,2-bis(4-hydroxyphenyl)-5-methylhexane; ethyl-4,4-bis(4-hydroxyphenyl)-pentanoate; isopropyl-4,4-bis(4-hydroxyphenyl) pentanoate; methyl-4,4-bis(4-hydroxyphenyl)-pentanoate; alkyl-4,4-bis(4-hydroxyphenyl)pentanoate; 3,3-bis(4-hydroxyphenyl)-pentane; 4,4-bis(4-hydroxyphenyl)-heptane; 2,2-bis(4-hydroxyphenyl)-1-phenylpropane; 2,2-bis(4-hydroxyphenyl)butane; 2,2'-methylene-bis(4-ethyl-6-tertiarybutyl phenol); 4-hydroxycoumarin; 7-hydroxy-4-methylcoumarin; 2,2'-methylene-bis(4-octyl phenol); 4,4'-sulfonyldiphenol; 4,4'-thio-bis(6-tertiarybutyl-m-cresol); methyl-p-hydroxybenzoate; propyl-p-hydroxybenzoate; benzyl-p-hydroxybenzoate. Preferred among these are the phenolic developer compounds. More preferred among the phenol compounds are 4,4'-isopropylidinediphenol, ethyl-4,4-bis(4-hydroxyphenyl)-pentanoate, n-propyl-4,4-bis(4-hydroxyphenyl)-pentanoate, isopropyl-4,4-bis(4-hydroxyphenyl) pentanoate, methyl 4,4-bis(4-hydroxyphenyl)pentanoate, 2,2-bis(4-hydroxyphenyl)-4-methylpentane, p-hydroxybenzophenone, 2,4-dihydroxybenzophenone, 1,1-bis(4-hydroxyphenyl) cyclohexane, and benzyl-p-hydroxybenzoate. Acid compounds of other kind and types are eligible.

Examples of such other compounds are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like. Some of the polymers and minerals do not melt but undergo color reaction on fusion of the chromogen.

The following examples are given to illustrate some of the features of the present invention and should not be considered as limiting. In these examples, all parts, percentages or proportions are by weight and all measurements are in the metric system, unless otherwise stated.

EXAMPLES

In all examples illustrated in the invention, a dispersion of a particular system component, was prepared by milling the component in an aqueous solution of the binder until a particle size of between about 1 micron and 10 microns was achieved. The milling was accomplished in an attritor or other suitable milling device. The desired average particle size was about 1 to 3 microns in each dispersion. Although the examples illustrate the invention using 2,2-bis(4-hydroxyphenyl)-4-methylpentane, 4-hydroxy4'-isopropoxy diphenylsulfone, or bis(4-hydroxy-3-allylphenyl)sulfone as the acidic developer material, the invention is readily practiced using any of the eligible acidic developer materials listed above.

The thermally-responsive sheets were made by making separate dispersions of chromogenic material, acidic material and a compound of formula 1. The dispersions were mixed in the desired ratios and applied to a support with a wire wound rod and dried. Other materials such as fillers, antioxidants, lubricants and waxes can be added if desired. The sheets may be calendered to improve smoothness.

Preparation of 2-Phenoxyethyl-n-Phenylcarbamate

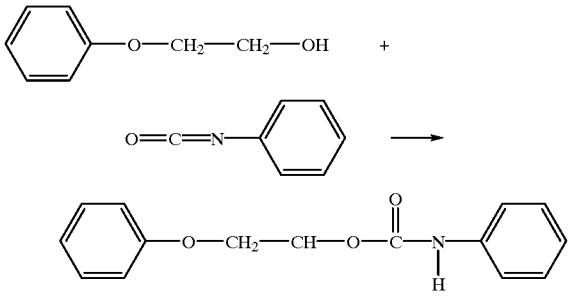

In a 4 l round bottom flask equipped with stirrer, dropping funnel and reflux condenser were placed

| | |
|---|---|
| 704 g | (5.10 moles) Phenoxyethanol (of about 99.6% purity) while stirring and |
| 1250 g | of toluene were added. |

The mixture was then heated to 65° C. to 70° C. Subsequently, 595 g (5.00 moles) Phenylisocyanate was added within about 3 to 4 hours under cooling the flask with cold water. The temperature was not allowed to rise above 90° C. The batch was held at 90° C. for one more hour after the end of phenylisocyanate addition. The reaction mixture was cooled down first to about 60 to 65° C. relatively fast, avoiding crystal separation on the wall of the flask. Crystallization started at somewhat below 60° C., and it was then important to cool down the product solution slowly. Otherwise, the product crystallized from the super saturated solution at once and a very thick crystal mass would be formed. After the beginning of crystallization, the flask was cooled down slowly (in about 3 hours) to 25° C. Temperature was held for one more hour. The product was isolated by filtration on a suction funnel. When the product began to fall dry, suction was interrupted and the mother liquor taken aside. The filter cake was washed two to three times with 250 ml of toluene for each wash. After the last wash, the wash liquor was removed as completely from the filter cake as possible and the crystals were dried in vacuo. The yield of the filter cake was ca. 1500 g before drying and ca. 1190 g (92.7% of theor. yield) after drying.

In the second and the following batches all the toluene from washing the product and up to 80% of the mother liquor were used instead of fresh toluene. The solvent volume amounts to 1500 g in the second and the following batches. The yield of those batches is 96 to 97% of the theoretical yield. The melting point correlates strongly with the product quality. It was at least 98° C.

DISPERSIONS

| Dispersion A - Chromogenic Material | Parts |
|---|---|
| Chromogenic Material | 32.0 |
| Binder, 20% solution of Polyvinyl alcohol in water | 27.4 |
| Defoaming and dispersing agents | 0.4 |
| Water | 40.2 |

Dispersion A1

Chromogenic Material is N102t 3-Diethyamino-6-methyl-7-anilinofluoran

Dispersion A2

Chromogenic Material is ODB-2 3-Dibutylamino-6-methyl-7-anilinofluoran

Dispersion A3

Chromogenic Material is black 305 3-Dipentylamino-6-methyl-7-anilinofluoran

Dispersion B

Acidic Material

| | |
|---|---|
| Acidic Material | 42.5 |
| Binder, 20% solution of Polyvinyl alcohol in water | 21.2 |
| Defoaming and dispersing agents | 0.2 |
| Water | 36.1 |

Dispersion B1

Acidic Material is AP-5 2,2-Bis(4-hydroxyphenyl)-4-methylpentane

Dispersion B2

Acidic Material is D8 4-Hydroxy-4'-isopropoxy diphenyl sulfone

Dispersion B3

Acidic Material is TGSA Bis(4-hydroxy-3-allylphenyl)sulphone

Dispersion C

Sensitizing Material

| | |
|---|---|
| Sensitizing Material | 42.5 |
| Binder, 20% solution of Polyvinyl alcohol in water | 21.2 |
| Defoaming and dispersing agents | 0.2 |
| Water | 36.1 |

Dispersion C1

Sensitizing Material is PPC 2-Phenoxyethyl-N-Phenylcarbamate

Dispersion C2

Sensitizing Material is PMC 2-Phenoxyethyl-N-Methylcarbamate

| Coating Formulation 1 | Parts |
|---|---|
| Dispersion A (Chromogenic) | 7.6 |
| Dispersion B (Acidic) | 15.0 |
| Dispersion C (Sensitizing) | 15.0 |
| Binder, 10% solution of polyvinyl alcohol in water | 45.5 |
| Filler slurry, 50% in water | 19.0 |

Example 1

Coating Formulation 1 Using
Dispersion Al (N 102t)
Dispersion B1 (AP-5)
Dispersion C1 (PPC)

Example 2

Coating Formulation 1 Using
Dispersion A2 (ODB-2)
Dispersion B1 (AP-5)
Dispersion C1 (PPC)

Example 3

Coating Formulation 1 Using
Dispersion A3 (Black 305)
Dispersion B1 (AP-5)
Dispersion C2 (PMC)

Example 4

Coating Formulation 1 Using
Dispersion A2 (ODB-2)
Dispersion B1 (AP-5)
Dispersion C2 (PMC)

Example 5

Coating Formulation 1 Using
Dispersion A1 (N102t)
Dispersion B2 (D8)
Dispersion C1 (PPC)

Example 6

Coating Formulation 1 Using
Dispersion A2 (ODB-2)
Dispersion B2 (D8)
Dispersion C1 (PPC)

Example 7

Coating Formulation 1 Using
Dispersion A3 (Black 305)
Dispersion B2 (D8)
Dispersion C2 (PMC)

Example 8

Coating Formulation 1 Using
Dispersion A2 (ODB-2)
Dispersion B2 (D8)
Dispersion C2 (PMC)

Example 9

Coating Formulation 1 Using
Dispersion Al (N102t)
Dispersion B3 (TGSA)
Dispersion C1 (PPC)

Example 10

Coating Formulation 1 Using
Dispersion A3 (Black 305)
Dispersion B3 (TGSA)
Dispersion C2 (PMC)

Example 11

Coating Formulation 1 Using
Dispersion A2 (ODB-2)
Dispersion B3 (TGSA)
Dispersion C2 (PPC)

| Coating Formulation 2 | Parts |
|---|---|
| Dispersion A (Chromogenic) | 7.6 |
| Dispersion B (Acidic) | 15.0 |
| Dispersion C (Sensitizing) | 0.0 |
| Binder, 10% solution of polyvinyl alcohol in water | 45.5 |
| Filler slurry, 50% in water | 19.0 |

Comparative Example 12

Coating Formulation 2 Using
Dispersion A1 (N102t)
Dispersion B1 (AP-5)

Comparative Example 13

Coating Formulation 2 Using
Dispersion A2 (ODB-2)
Dispersion B1 (AP-5)

Comparative Example 14

Coating Formulation 2 Using
Dispersion A3 (BLACK-305)
Dispersion B1 (AP-5)

Comparative Example 15

Coating Formulation 2 Using
Dispersion A1 (N102t)
Dispersion B2 (D8)

Comparative Example 16

Coating Formulation 2 Using
Dispersion A2 (ODB-2)
Dispersion B2 (D8)

Comparative Example 17

Coating Formulation 2 Using
Dispersion A3 (BLACK-305)
Dispersion B2 (D8)

Comparative Example 18

Coating Formulation 2 Using

Dispersion A1 (N102t)

Dispersion B3 (TGSA)

Comparative Example 19

Coating Formulation 2 Using

Dispersion A2 (ODB-2)

Dispersion B3 (TGSA)

Comparative Example 20

Coating Formulation 2 Using

Dispersion A3 (BLACK-305)

Dispersion B3 (TGSA)

The examples were coated at 3.0 gm/m$^2$. The examples were then printed on the ATLANTEK model 300. The optical density was measured using a MacBeth II densitometer. The results are shown in Table 1. Imaged on an Atlantek Model 300. Optical Density of the image formed was read using a MacBeth Answer II densitometer.

TABLE 1

| mJ/mm$^2$ | Ex. 1 | Ex. 2 | Ex. 3 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|---|
| 10.449 | 0.11 | 0.08 | 0.10 | 0.12 | 0.16 | 0.07 | 0.15 | 0.16 | 0.28 | 0.27 | 0.24 |
| 12.000 | 0.32 | 0.26 | 0.49 | 0.43 | 0.40 | 0.14 | 0.55 | 0.67 | 0.54 | 0.67 | 0.86 |
| 15.224 | 0.49 | 0.39 | 0.61 | 0.71 | 0.64 | 0.32 | 0.91 | 0.97 | 0.77 | 0.98 | 1.11 |
| 17.755 | 0.67 | 0.55 | 0.85 | 0.85 | 0.76 | 0.46 | 1.06 | 1.18 | 0.81 | 1.11 | 1.31 |
| 19.592 | 0.81 | 0.60 | 1.08 | 1.04 | 0.91 | 0.63 | 1.22 | 1.35 | 0.93 | 1.26 | 1.31 |
| 21.265 | 0.99 | 0.77 | 1.17 | 1.15 | 1.04 | 0.78 | 1.33 | 1.43 | 1.00 | 1.36 | 1.43 |
| 25.184 | 1.01 | 0.91 | 1.19 | 1.34 | 1.16 | 0.89 | 1.36 | 1.44 | 1.08 | 1.44 | 1.47 |
| 28.571 | 1.20 | 0.92 | 1.21 | 1.35 | 1.22 | 0.97 | 1.41 | 1.44 | 1.10 | 1.43 | 1.48 |
| 31.837 | 1.28 | 1.06 | 1.45 | 1.41 | 1.28 | 1.11 | 1.42 | 1.44 | 1.22 | 1.48 | 1.47 |
| 37.551 | 1.40 | 1.24 | 1.46 | 1.45 | 1.40 | 1.35 | 1.43 | 1.45 | 1.38 | 1.50 | 1.48 |

| | Comparative Examples | | | | | | | | |
|---|---|---|---|---|---|---|---|---|---|
| mJ/mm$^2$ | Comp. Ex. 12 | Comp. Ex. 13 | Comp. Ex. 14 | Comp. Ex. 15 | Comp. Ex. 16 | Comp. Ex. 17 | Comp. Ex. 18 | Comp. Ex. 19 | Comp. Ex. 20 |
| 10.45 | 0.08 | 0.07 | 0.08 | 0.09 | 0.06 | 0.09 | 0.20 | 0.14 | 0.12 |
| 12.00 | 0.12 | 0.07 | 0.21 | 0.18 | 0.10 | 0.31 | 0.29 | 0.43 | 0.35 |
| 15.22 | 0.20 | 0.14 | 0.42 | 0.34 | 0.24 | 0.54 | 0.38 | 0.63 | 0.56 |
| 17.76 | 0.31 | 0.25 | 0.58 | 0.50 | 0.34 | 0.75 | 0.54 | 0.77 | 0.75 |
| 19.59 | 0.42 | 0.27 | 0.82 | 0.65 | 0.45 | 0.98 | 0.64 | 0.99 | 0.94 |
| 21.27 | 0.49 | 0.43 | 0.99 | 0.85 | 0.65 | 1.14 | 0.83 | 1.20 | 1.10 |
| 25.18 | 0.62 | 0.50 | 1.10 | 1.00 | 0.72 | 1.27 | 0.92 | 1.22 | 1.19 |
| 28.57 | 0.63 | 0.62 | 1.16 | 1.12 | 0.80 | 1.34 | 0.97 | 1.30 | 1.26 |
| 31.84 | 0.78 | 0.86 | 1.28 | 1.27 | 1.06 | 1.38 | 1.06 | 1.34 | 1.40 |
| 37.55 | 0.85 | 1.15 | 1.46 | 1.37 | 1.35 | 1.49 | 1.35 | 1.50 | 1.49 |

The results in the table demonstrate that the record material of the invention with the carbamate compound has improved thermal response and/or more intense or faster imaging than record systems without the material.

The principles, preferred embodiments, and modes of operation of the invention have been described in the foregoing specification. The invention which is intended to be protected herein, however, is not to be construed as limited to the particular forms disclosed, since these are to be regarded as illustrative rather than restrictive. Variations and changes can be made by those skilled in the art without departing from the spirit and scope of the invention.

What is claimed is:

1. A thermally-responsive record material comprising a support having provided thereon in substantially contiguous relationship (i) a chromogenic material, (ii) an acidic developer material, and (iii) a carbamate component selected from the group of compounds consisting of N-phenyl-N-(2-phenoxyethoxycarbonyl)amine, N-phenyl-N-(2-(3-methoxyphenoxy) ethoxycarbonyl)amine, N-(2-methylphenyl)-N-(2-phenoxyethoxy-carbonyl)amine, N-(2-methylphenyl)-N-(2-(4-methylphenoxy)ethoxy-carbonyl) amine, N-phenyl-N-(2-(2-chlorphenoxy)ethoxycarbonyl) amine, N-(4-chlorphenyl)-N-(2-phenoxyethoxycarbonyl) amine, N-(2-methylphenyl)-N-(2-(2-methoxyphenoxy) ethoxycarbonyl)amine, N-(4-chlorphenyl)-N-(2-(3-methylphenoxy)ethoxycarbonyl)amine, N-(4-chlorphenyl)-N-(2-(2-methylphenoxy) ethoxycarbonyl)amine, N-phenyl-N-(2-(4-chlorphenoxy)-ethoxycarbonyl)amine, N-phenyl-N-(2-(4-methylphenoxy)ethoxycarbonyl)-amine, N-(4-chlorphenyl)-N-(2-(4-methylphenoxy)ethoxycarbonyl) amine, N-(4-chlorphenyl)-N-(2-(2-chlorphenoxy) ethoxycarbonyl)amine, N-(4-chlorphenyl)-N-(2-(4-chlorphenoxy)ethoxycarbonyl)amine, N-(4-chlorphenyl)-N-(2-(2-methoxyphenoxy)ethoxycarbonyl)amine, N-(3-methylphenyl)-N-(2-phenoxyethoxycarbonyl)amine, N-(3-methylphenyl)-N-(2-(2-methylphenoxy)ethoxycarbonyl) amine, N-(3-methylphenyl)-N-(2-(3-methylphenoxy) ethoxycarbonyl)amine, N-(3-methylphenyl)-N-(2-(2-chlorphenoxy)ethoxycarbonyl)amine, N-(3-methylphenyl)-N-(2-(2,4-dichlorphenoxy)ethoxycarbonyl)amine, N-(2-methylphenyl)-N-(2-(2,4-dichlorphenoxy)ethoxycarbonyl) amine, N-(2-methylphenyl)-N-(2-(2-chlorphenoxy) ethoxycarbonyl)amine, N-(3-methylphenyl)-N-(2-(2-methoxyphenoxy)ethoxycarbonyl)amine, N-phenyl-N-(2-(2-methylphen-oxy)ethoxycarbonyl)amine, N-(2-methylphenyl)-N-(2-(2-methylphenoxy)-ethoxycarbonyl) amine, N-phenyl-N-(2-(2,4-dichlorphenoxy)ethoxy-carbonyl)amine, N-(3-methylphenyl)-N-(2-(4-methyl-phenoxy)ethoxycarbonyl)amine, N-(2-methylphenyl)-N-(2-(3-methylphenoxy)ethoxycarbonyl)-amine and N-phenyl-N-(2-(4-methylphenoxy)ethoxycarbonyl)amine, N-(4-ethylphenyl)-N-(2-phenoxyethoxycarbonyl)amine and N-(4-methylphenyl)-N-(2-phenoxyethoxycarbonyl)amine, wherein the carbamate component is not dodecyl-N-phenylcarabamate, B) compounds according to formula (II):

(II)

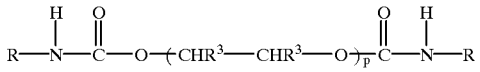

C) compounds according to formula (III):

(III)

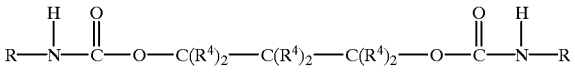

wherein $R^4$ represents independently from each other H or $C_1$–$C_6$ alkyl and R is selected from the group consisting of substituted and unsubstituted aryl groups having from 6 to 18 carbon atoms, substituted and unsubstituted alkyl groups having from 1 to 8 carbon atoms, and substituted and unsubstituted aralkyl groups having from 1 to 8 carbon atoms;

D) compounds according to formula (IV):

(IV)

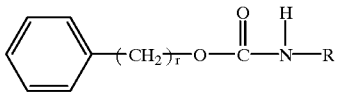

wherein r is 0, 1 or 2 and R has the same meaning as in formula (I);

E) compounds according to formula (V):

(V)

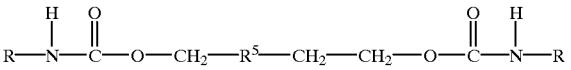

wherein $R^5$ is

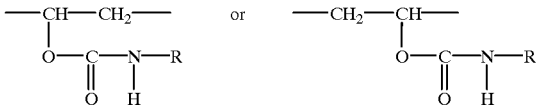

wherein R has the same meaning as in formula (I) and

F) compounds according to formula (VI):

(VI)

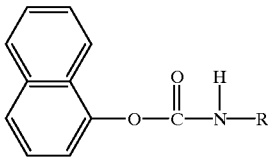

wherein R has the same meaning as in formula (I);

G) compounds according to formula (VII):

(VII)

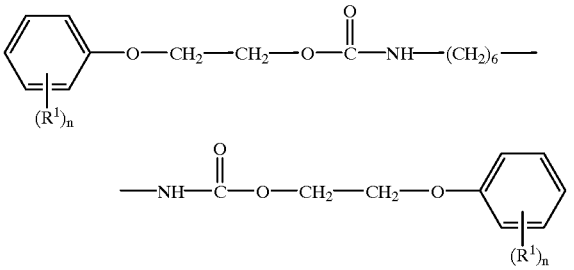

wherein $R^1$ is selected from the group consisting of $OCH_3$, $CH_3$ and Cl, and n is 0, 1, or 2; and (VIII)

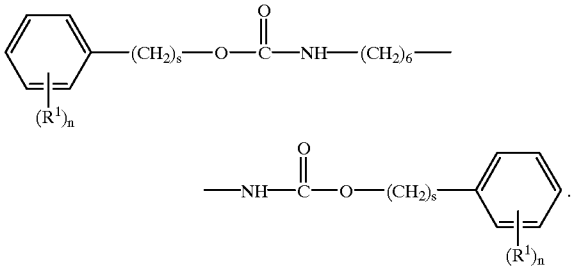

2. The thermally-responsive record material of claim 1 further comprising a pre-coat, on the support, that includes hollow sphere particles.

3. The thermally-responsive record material of claim 2 wherein the thermally-responsive record further comprises a top-coat.

4. The thermally-responsive record material of claim 3 wherein the top coat comprises a polymeric material comprising a component selected from the group consisting of polyvinyl alcohol and carboxylated polyvinyl alcohol.

5. The thermally-responsive record material of claim 2, wherein the record material further comprises a back coat.

6. The thermally-responsive record material of claim 5, wherein the back coat comprises hollow sphere particles.

7. A thermally-responsive record material comprising a support having provided thereon in substantially contiguous relationship (i) a chromogenic material, (ii) an acidic developer material, and (iii) a carbamate component; wherein the carbamate component is not dodecyl-N-phenylcarbamate and comprises a carbamate selected from the group of compounds consisting of:

A) compounds according to formula (I):

(I)

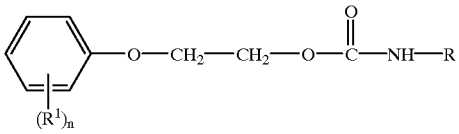

wherein R is selected from the group consisting of substituted and unsubstituted aryl groups having from 6 to 18 carbon atoms, substituted and unsubstituted alkyl groups having from 1 to 8 carbon atoms, and substituted and unsubstituted aralkyl groups having from 1 to 8 carbon atoms, and $R^1$ includes a component selected from the group consisting of $OCH_3$, $CH_3$ and Cl, and n is 0, 1, or 2;

B) a component selected from the group consisting of

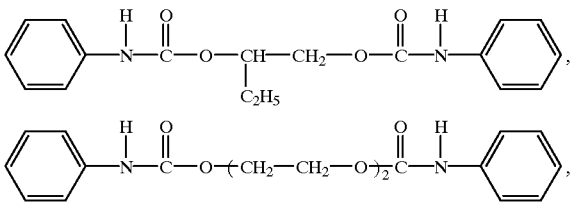

-continued and

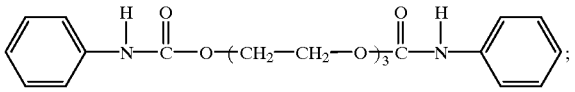

C) compounds according to formula (III):

(III)

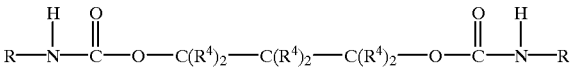

wherein $R^4$ represents independently from each other H or $C_1$–$C_6$ alkyl and R has the same meaning as in formula (I);

D) compounds according to formula (IV):

(IV)

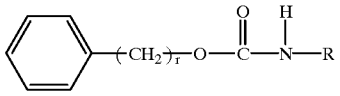

wherein r is 0, 1 or 2 and R has the same meaning as in formula (I);

E) compounds according to formula (V):

(V)

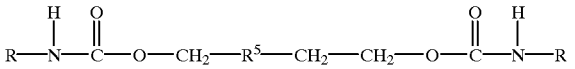

wherein $R^5$ is

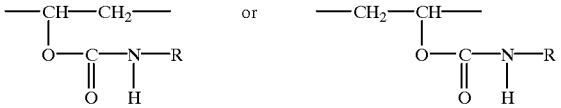

wherein R has the same meaning as in formula (I) and

F) compounds according to formula (VI):

(VI)

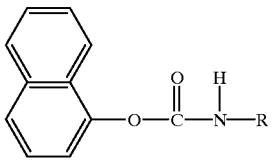

wherein R has the same meaning as in formula (I);

G) compounds according to formula (VII):

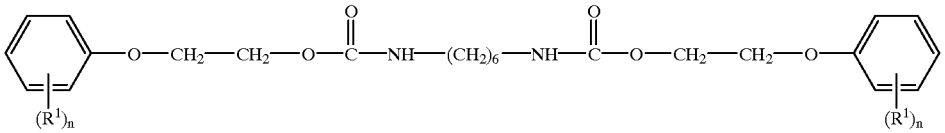

(VII)

wherein $R^1$ and n have the same meaning as in formula (I) and

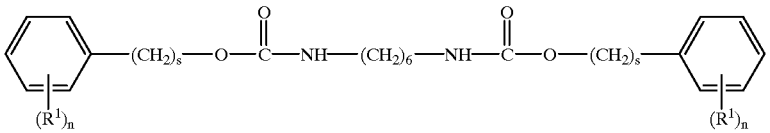

(VIII)

wherein $R^1$ and n have the same meaning as in formula (I) and s is 0,1 or 2.

8. A thermally-responsive record material comprising a support having provided thereon in substantially contiguous relationship (i) a chromogenic material, (ii) an acidic developer material, and (iii) a carbamate component; wherein the carbamate component is not dodecyl-N-phenylcarbamate and comprises a carbamate selected from the group of compounds consisting of:

A) compounds according to formula (I):

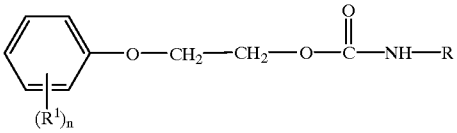

(I)

wherein R is selected from the group consisting of substituted and unsubstituted aryl groups having from 6 to 18 carbon atoms, substituted and unsubstituted alkyl groups having from 1 to 8 carbon atoms, and substituted and unsubstituted aralkyl groups having from 1 to 8 carbon atoms, and $R^1$ includes a component selected from the group consisting of $OCH_3$, $CH_3$ and Cl, and n is 0, 1, or 2;

B) compounds according to formula (II):

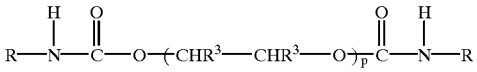

(II)

wherein p is 1, 2 or 3, $R^3$ represents independently from each other H or ethyl and R has the same meaning as in formula (I);

C) a component selected from the group consisting of

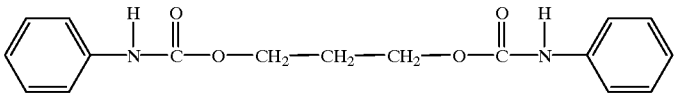

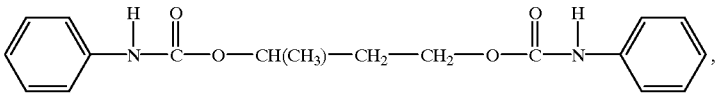

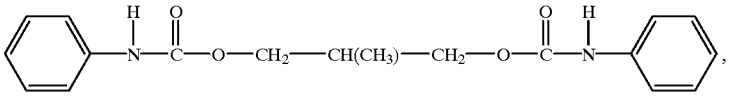

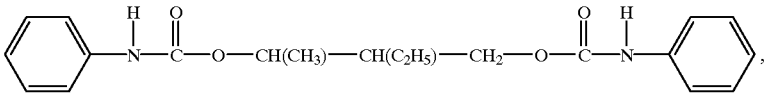

-continued
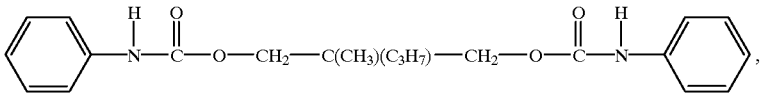
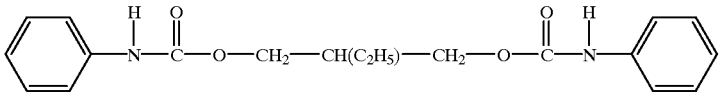
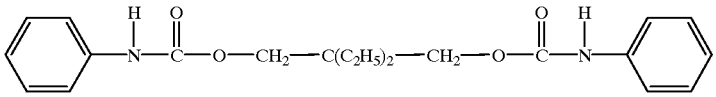
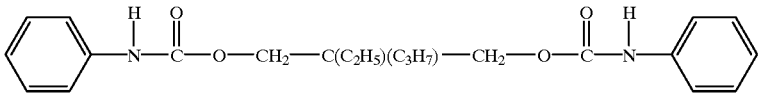
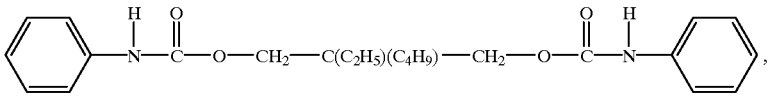
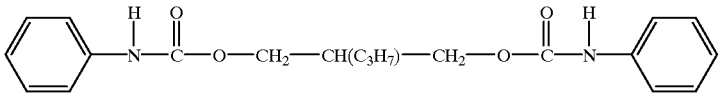
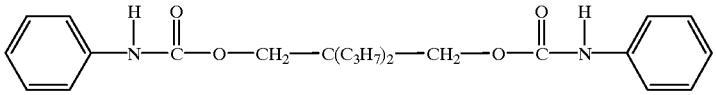
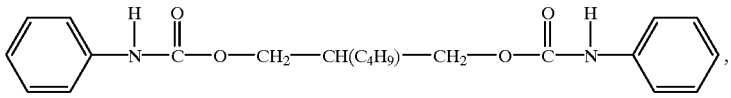
and
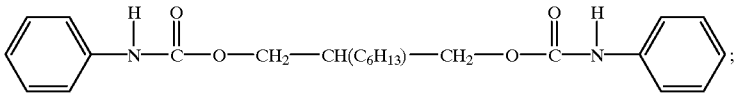
D) compounds according to formula (IV):
(IV)
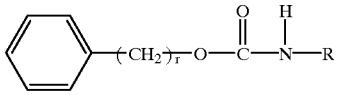
wherein r is 0, 1 or 2 and R has the same meaning as in formula (I);
E) compounds according to formula (V):
(V)
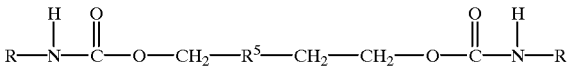
wherein $R^5$ is
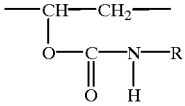
or
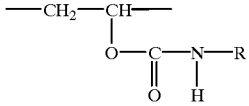
wherein R has the same meaning as in formula (I) and
F) compounds according to formula (VI):
(VI)
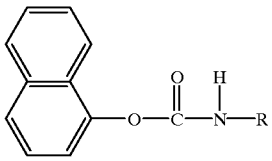
wherein R has the same meaning as in formula (I);

G) compounds according to formula (VII):

(VII)

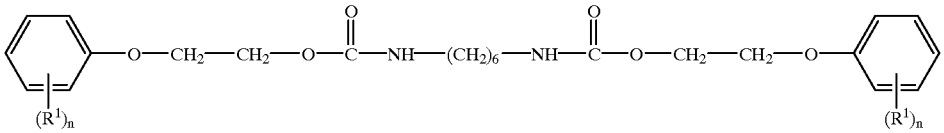

wherein $R^1$ and n have the same meaning as in formula (I) and

H) compounds according to formula (VIII):

(VIII)

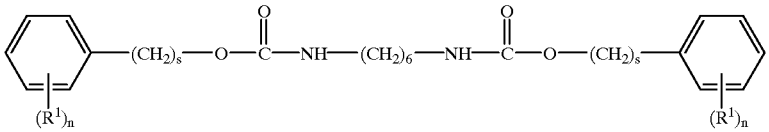

wherein $R^1$ and n have the same meaning as in formula (I) and s is 0,1 or 2.

9. A thermally-responsive record material comprising a support having provided thereon in substantially contiguous relationship (i) a chromogenic material, (ii) an acidic developer material, and (iii) a carbamate component; wherein the carbamate component is not dodecyl-N-phenylcarbamate and comprises a carbamate selected from the group of compounds consisting of:

A) compounds according to formula (I):

(I)

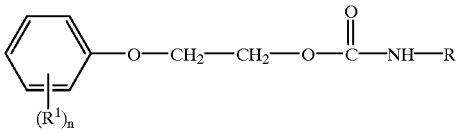

wherein R is selected from the group consisting of substituted and unsubstituted aryl groups having from 6 to 18 carbon atoms, substituted and unsubstituted alkyl groups having from 1 to 8 carbon atoms, and substituted and unsubstituted aralkyl groups having from 1 to 8 carbon atoms, and $R^1$ includes a component selected from the group consisting of $OCH_3$, $CH_3$ and Cl, and n is 0, 1, or 2;

B) compounds according to formula (II):

(II)

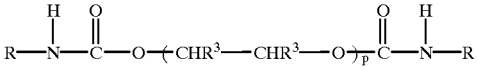

wherein p is 1, 2 or 3, $R^3$ represents independently from each other H or ethyl and R has the same meaning as in formula (I);

C) compounds according to formula (III):

(III)

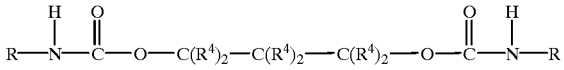

wherein $R^4$ represents independently from each other H or $C_1$–$C_6$ alkyl and R has the same meaning as in formula (I);

D) compounds selected from the group consisting of

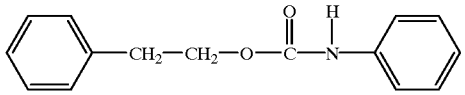

,

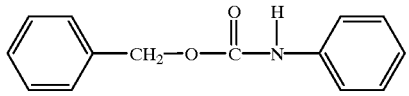

, and

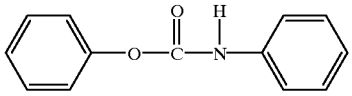

;

E) compounds according to formula (V):

(V)

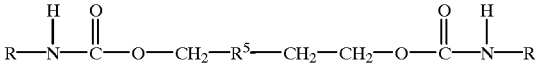

wherein $R^5$ is

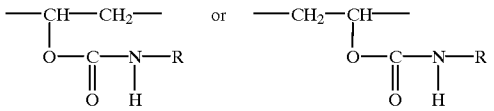

wherein R has the same meaning as in formula (I) and

F) compounds according to formula (VI):

(VI)

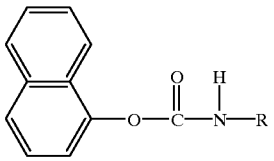

wherein R has the same meaning as in formula (I);

G) compounds according to formula (VII):

(VII)

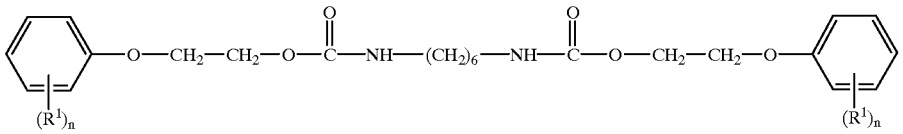

wherein $R^1$ and n have the same meaning as in formula (I) and

H) compounds according to formula (VIII):

(VIII)

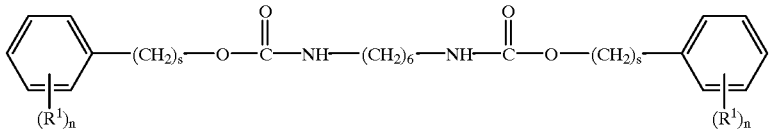

wherein $R^1$ and n have the same meaning as in formula (I) and s is 0,1 or 2.

10. A thermally-responsive record material comprising a support having provided thereon in substantially contiguous relationship (i) a chromogenic material, (ii) an acidic developer material, and (iii) a carbamate component; wherein the carbamate component is not dodecyl-N-phenylcarbamate and comprises a carbamate selected from the group of compounds consisting of:

A) compounds according to formula (I):

(I)

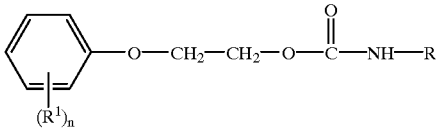

wherein R is selected from the group consisting of substituted and unsubstituted aryl groups having from 6 to 18 carbon atoms, substituted and unsubstituted alkyl groups having from 1 to 8 carbon atoms, and substituted and unsubstituted aralkyl groups having from 1 to 8 carbon atoms, and $R^1$ includes a component selected from the group consisting of $OCH_3$, $CH_3$ and Cl, and n is 0, 1, or 2;

B) compounds according to formula (II):

(III)

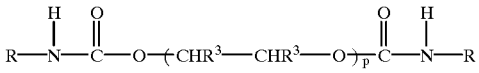

wherein p is 1, 2 or 3, $R^3$ represents independently from each other H or ethyl and R has the same meaning as in formula (I);

C) compounds according to formula (III):

(III)

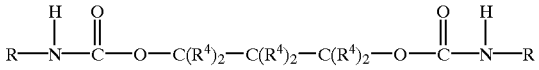

wherein $R^4$ represents independently from each other H or $C_1$–$C_6$ alkyl and R has the same meaning as in formula (I);

D) compounds according to formula (IV):

(IV)

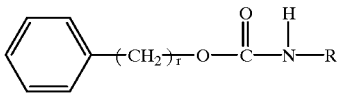

wherein r is 0, 1 or 2 and R has the same meaning as in formula (I);

E) a component selected from the group consisting of
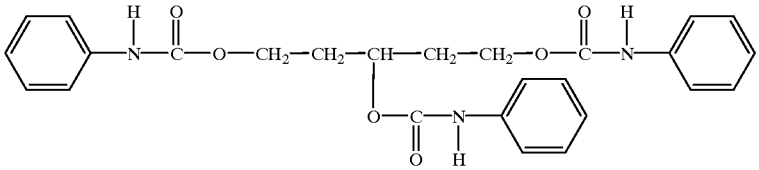
,
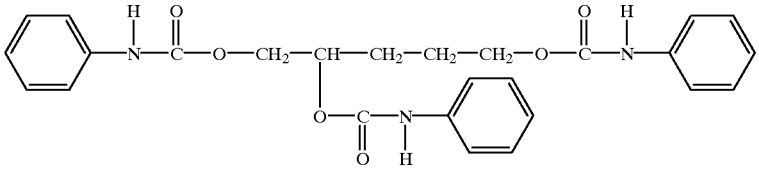
,
and
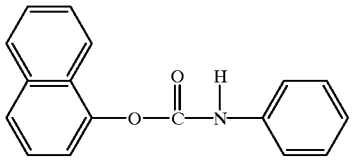
;
F) compounds according to formula (VII):
(VII)
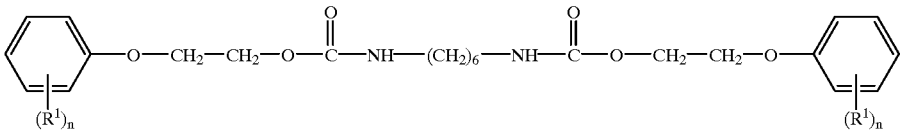
wherein $R^1$ and n have the same meaning as in formula (I) and s is 0, 1 or 2.
G) compounds according to formula (VIII):
(VIII)
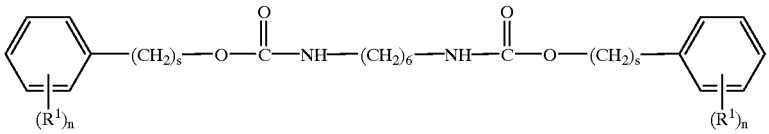
wherein $R^1$ and n have the same meaning as in formula
* * * * *